US006001454A

United States Patent [19]

Murata et al.

[11] Patent Number: 6,001,454

[45] Date of Patent: Dec. 14, 1999

[54] CHARGING MEMBER AND ELECTROPHOTOGRAPHIC APPARATUS USING THE SAME

[75] Inventors: Jun Murata, Kawagoe; Yoshiaki Nishimura, Tokyo; Hiroshi Mayuzumi, Kawasaki, all of Japan

[73] Assignee: Canon Kabushiki Kaisha, Tokyo, Japan

[21] Appl. No.: 08/904,864

[22] Filed: Aug. 1, 1997

[30] Foreign Application Priority Data

Aug. 2, 1996 [JP] Japan ..... 8-204802

[51] Int. Cl.[6] ..... G03G 15/02

[52] U.S. Cl. ..... 428/141; 428/36.5; 428/35.7; 428/36.8; 428/495; 428/521; 399/176; 492/59

[58] Field of Search ..... 428/141, 36.5, 428/35.7, 36.8, 495, 521; 399/176; 492/59

[56] References Cited

U.S. PATENT DOCUMENTS

| | | | |
|---|---|---|---|
| 5,440,374 | 8/1995 | Kisu | 355/219 |
| 5,471,285 | 11/1995 | Nagase et al. | 355/219 |
| 5,733,235 | 3/1998 | Waku et al. | 492/25 |
| 5,751,801 | 5/1998 | Murata et al. | 399/176 |
| 5,766,753 | 6/1998 | Murata et al. | 428/323 |

*Primary Examiner*—William P. Watkins, III

*Attorney, Agent, or Firm*—Fitzpatrick, Cella, Harper & Scinto

[57] ABSTRACT

A charging member supplied with a voltage to charge a charge-receiving member such as an electrophotographic photosensitive member has an elastic layer of an ethylene-propylene copolymer containing a diene component. The ethylene-propylene copolymer has an iodine value of 23–32. The charging member is improved in resistance to permanent deformation while providing excellent images for a long period.

10 Claims, 4 Drawing Sheets

CHARGING MEMBER AND ELECTROPHOTOGRAPHIC APPARATUS USING THE SAME

FIELD OF THE INVENTION AND RELATED ART

The present invention relates to a charging member supplied with a voltage for charging a charge-receiving member (a member to be charged) in contact with or in proximity to the charge-receiving member, and a process cartridge and an image forming apparatus using the charging member.

In an image forming apparatus including an electrophotographic apparatus (such as a copying machine or a laser beam printer) and an electrostatic recording apparatus, a corona discharger has widely been used heretofore, as means for charging the surface of an image-carrying member as a charge-receiving member including a photosensitive member, a dielectric material, etc. Such a corona discharger is an effective means for uniformly charging the surface of a charge-receiving member, such as an image-carrying member to a desired potential level.

However, the corona charger requires a high-voltage power supply and utilizes corona discharge, thus being accompanied with a problem such as occurrence of ozone.

In contrast to such a corona discharger, a contact or proximity charging device as mentioned above is advantageous because it allows a lower applied voltage provided by a power supply, and generates less ozone.

Such a contact or proximity charging member is generally required to have an appropriate electroconductivity for effecting uniform charging of the charge-receiving member, such as a photosensitive member, and prevention of charge leakage due to damages, such as pinholes and scars on the surface of the charge-receiving member, and is also required to ensure a uniform contact with the photosensitive (charge-receiving) member. In addition, in the case where the charging member is used by applying thereto an AC voltage, the charging member is required to have a low hardness in order to suppress the noise caused by vibration between the charging member and the photosensitive member due to a charge in electric field.

However, when the charging member having a low hardness is caused to come in contact with the photosensitive member under pressure for a long period of time, the charging roller is liable to cause permanent deformation leading to abnormal images due to excessive current or overcurrent from a nip portion (between the charging member and the photosensitive member) and is nonuniformly abutted or pressed against at the deformed portion during the rotation thereof, thus resulting in uneven exposure to cause image failure.

The charging member generally has an electroconductive elastic layer of an elastomeric material, such as elastomeric polymer. Examples of such a polymer may include polybutadiene, styrene-butadiene rubber (SBR), chloroprene rubber (CR), acrylonitrile-butadiene rubber (NBR), silicone rubber, polyurethane rubber, and epichlorohydrin rubber.

Of these, however, the polymers of butadiene rubber-type having an unsaturated bond in a main chain are liable to be deteriorated due to breakage of the unsaturated bond after long-term use, thus being unsuitable for the long-term use. Even if such a polymer (of butadiene rubber-type) contains, e.g., an antioxidant (or age resistor) in order to prevent the deterioration, the antioxidant can migrate to the photosensitive member, thus soiling the photosensitive member surface. The silicone rubber shows a small permanent deformation but is expensive. The polyurethane rubber of polyester-type is liable to become unstable in the long-term use due to its hydrolyzing property and that of polyether-type shows a water absorption property to lower its environmental stability in some cases. The epichlorohydrin rubber is liable to show a large compression set particularly when used as a foamed material, thus being practically problematic.

SUMMARY OF THE INVENTION

In view of the above-mentioned problems, an object of the present invention is to provide a charging member showing less deformation even in contact with a photosensitive member under pressure for a long period thereby to provide good images even after being left standing for a long period and providing less noise of the charging by applying an AC voltage to the charging member.

Another object of the present invention is to provide a process cartridge or electrophotographic apparatus including such a charging member.

According to the present invention, there is provided a charging member, which is supplied with a voltage to charge a charge-receiving member, having an elastic layer comprising an ethylene-propylene copolymer containing a diene component; wherein said ethylene-propylene copolymer has an iodine value of 23 –32.

According to the present invention, there is also provided a process cartridge, detachably mountable to an electrophotographic apparatus main body, comprising a charging member and a photosensitive member; wherein said charging member has an elastic layer comprising an ethylene-propylene copolymer containing a diene component, said ethylene-propylene copolymer having an iodine value of 23–32.

According to the present invention, there is further provided an electrophotographic apparatus, comprising a charging member and a photosensitive member; wherein said charging member has an elastic layer comprising an ethylene-propylene copolymer containing a diene component, said ethylene-propylene copolymer having an iodine value of 23–32.

The "iodine value of 23–32" used herein for defining the ethylene-propylene copolymer constituting the charging member of the present invention is based on values measured according to Wijs method with respect to the ethylene-propylene copolymer as a starting material for constituting the elastic layer of the charging member but has been confirmed to have a good correspondence as represented by a calibration curve with the iodine value of the ethylene-propylene copolymer in the elastic layer of the product charging member.

In the present invention, the ethylenepropylene copolymer containing a diene component used as a material for the elastic layer of the charging member has no diene bond in its main chain, so that such a copolymer does not cause deterioration and hydrolysis after the long-term use and is excellent in environmental stability. Further, such a copolymer having no diene bond in its main chain generally has a larger flowability of the main chain, thus being liable to increase a compression set. In the present invention, in order to decrease a compression set of a resultant copolymer, an iodine value (of the resultant copolymer) as an index representing an amount of a diene component (third component) is set in a range of 23–32. More specifically, if the iodine value is below 23, a crosslink density becomes insufficient, thus resulting in a larger flowability of the main chain to increase a compression set. If the iodine value exceeds 32, an amount of the diene component is increased, thus being disadvantageous with respect to ozone deterioration. As a result, the resultant ethylene-propylene copolymer is lowered in its properties.

Accordingly, by using an ethylene-propylene copolymer, containing a diene component, having an iodine value of 23–32 as a material for the elastic layer of the charging member, it is possible to decrease a deformation evening contact with the photosensitive member under pressure for a long period. As a result, even when the resultant charging member is left standing for a long period, good images can be obtained and charging properties can be stabilized against a change in environmental conditions. Further, the charging member does not soil the photosensitive member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
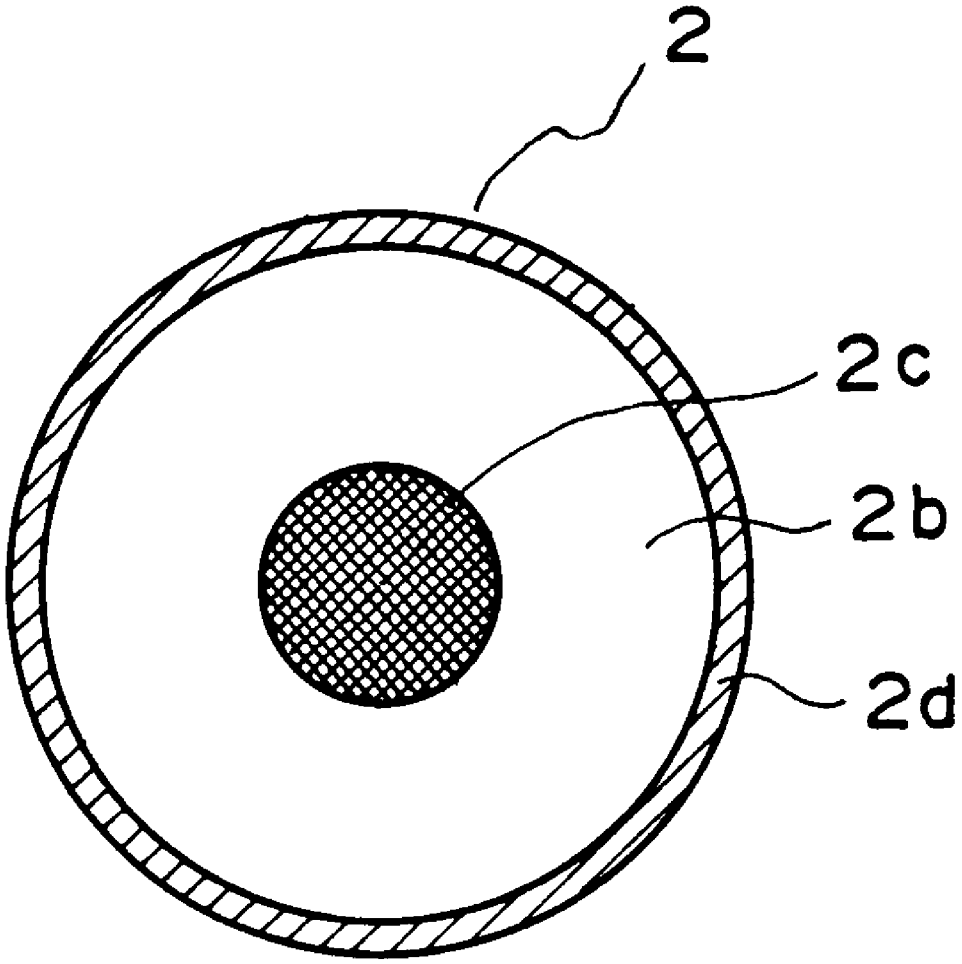
FIG. 1 is a cross-sectional illustration of a charging member (roller) according to the invention.

The diene component contained in the ethylene-propylene copolymer constituting the elastic layer of the charging roller according to the present invention may include known dienes, such as ethylidene norbornene and dicyclopentadiene. These dienes generally show a tendency to saturate its crosslinking effect with respect to the addition providing an iodine value of 20 or above. Accordingly, a remarkable improvement in physical properties of the resultant copolymer is not generally expected.

In the present invention, as the diene component, ethylidene norbornene and vinyl norbornene may preferably be used in combination to enhance reactivity, thus developing a three-dimensional network structure to further improve the resultant physical properties including a decrease in compression set.

Further, the use of ethylidene norbornene and vinyl norbornene in combination is effective in maintaining a rubber elasticity due to a molecular entanglement effect even in an unvulcanized state. As a result, e.g., in extrusion, shaping failure or irregular shaping is not readily caused. This is particularly advantageous to foam molding for providing a charging member, such as a charging roller or a transfer roller, requiring a high shape accuracy.

The ethylene-propylene copolymer used in the present invention may suitably be used in the form of a foam in order to provide a low hardness.

As a foaming agent used at this time, azodicarbonamide (hereinbelow abbreviated as "ADCA") and p,p'-oxybis (benzenesulfonylhydrazide) (abbreviated as "OBSH") may preferably be used in combination.

The resultant foamed copolymer is generally required to have a smaller foam diameter (e.g., 20–200 $\mu$m) in view of uniform charging. In this regard, the addition of oxybis (benzenesulfonylhydrazide) (OBSH) is effective but causes occurrence of a large amount of water content at the time of decomposition thereof to cause non-uniform foaming or retard a vulcanization reaction, thus damaging the elasticity of the resulting foamed copolymer. However, when azodicarbonamide (ADCA) is used in combination with OBSH the vulcanization reaction can be promoted under alkaline conditions to provide a foamed copolymer rich in rubber elasticity and having a small foam diameter.

The foaming agents OBSH and ADCA may preferably be mixed in a ratio of OBSH/ADCA=1/5 to 5/1 (by weight) and may preferably be used in an amount of 4–40 wt. parts in total per 100 wt. parts of the ethylene-propylene copolymer (containing the diene component).

If the mixing ratio (OBSH/ADCA) is at least 1/5, an occurrence of a foam having a large foam diameter can be suppressed to provide a good image. Further, if the mixing ratio is at most 5/1, it is possible to provide a sufficient rubber elasticity and a uniform foam diameter, thus realizing a good image.

In the present invention, the ethylene propylene copolymer before vulcanization and/or foaming may generally be synthesized through an ordinary copolymerization process.

More specifically, a monomer mixture comprising ethylene, propylene, and a diene component (ethylene norbornene, vinyl norbornene, dicyclopentadiene, etc.) was polymerized in the presence of a vanadium-based catalyst (e.g., $VCl_4$, $VOCl_4$ or $VOCl_3$) and an organic aluminum-based catalyst (e.g., $AlR_2Cl$ or $AlR_3Cl_3$; R=alkyl) in an appropriate organic solvent.

At this time, a monomer ratio of ethylene/propylene may generally be set to 50/50 to 85/15 by mol. %. Further, the diene component may be added in an appropriate amount so as to provide a desired iodine value to the resultant copolymer.

The charging member of the present invention may preferably have a surface roughness Rz (determined as a roughness average of ten measurements according to JIS B 0601) of at most 10 $\mu$m.

If the surface roughness of the charging member exceeds 10 $\mu$m, the local discharge from the projections of the charge member surface is liable to damage the surface of the photosensitive member to form a defective portion through which a current passes, thus causing charging failure to shorten the life of the photosensitive member and damage its durability.

Hereinbelow, preferred embodiments of the present invention will be described more specifically with reference to FIGS. 1–3.

FIG. 1 shows an embodiment of a charging roller 2 as the charging member of the present invention.

Referring to FIG. 1, the charging roller 2 includes an electroconductive cylindrical support of metal (core metal) 2*c*, an elastic layer 2*b* disposed on the core metal 2*c* and comprising the above-mentioned ethylene-propylene copolymer, and a surface layer 2*d* disposed on the elastic layer 2*b* and controlled to have an appropriate resistance sufficient to prevent leakage caused due to defects such as pinholes and scars on the surface of the charge-receiving (photosensitive) member.

In the present invention, the elastic layer 2*b* may have an elasticity allowing an application of a charging bias voltage to the photosensitive member and a uniform contact thereof with the photosensitive member under pressure and may preferably show a semiconductor property providing a resistance of $1\times10^5$–$1\times10^9$ ohm.cm.

In the case of forming a semiconductive elastic layer 2*b* on the core metal 2*c*, an electroconductive filler may preferably be incorporated in the elastic layer 2*b* in an appropriate amount, thus adjusting a resistance to a desired level.

Examples of the electroconductive filler may include: carbon black, graphite; powders of metal oxide and metal, such as titanium oxide, tin oxide, Cu and Ag; electroconductive particles including particles surface-coated with the above materials; and ionic electrolytes, such as $LiClO_4$, KSCN, NaSCN and $LiCF_3SO_3$.

The elastic layer 2*b* may generally be formed by, e.g., extrusion, press molding or injection molding.

The surface layer 2*d* is a layer for preventing breakage of the charging member and/or the photosensitive layer caused due to concentration of charging current at a defective portion in the case where defects such as pinholes occur. In this regard, the surface layer 2*d* may preferably have a resistance of $1\times10^2$–$1\times10^9$ ohm.

The surface layer 2*d* may generally be formed by adding the above-mentioned electroconductive filler in an appropriate amount to a binder polymer, such as acrylic resin, polyurethane, polyamide, polyester, polyolefin or silicone resin.

The surface layer 2*d* may generally be prepared in the following manner.

The binder polymer for the surface layer 2*d* is dissolved or dispersed in an appropriate solvent, to which the electroconductive filler is added to form a coating liquid. The coating liquid is then applied onto the surface of the elastic layer 2*b* by dipping, beam coating or roll coating. It is also possible to coat the elastic layer 2*b* with a cylindrical shaped article formed by kneading or blending the binder polymer with the electroconductive filler.

Figure 2:
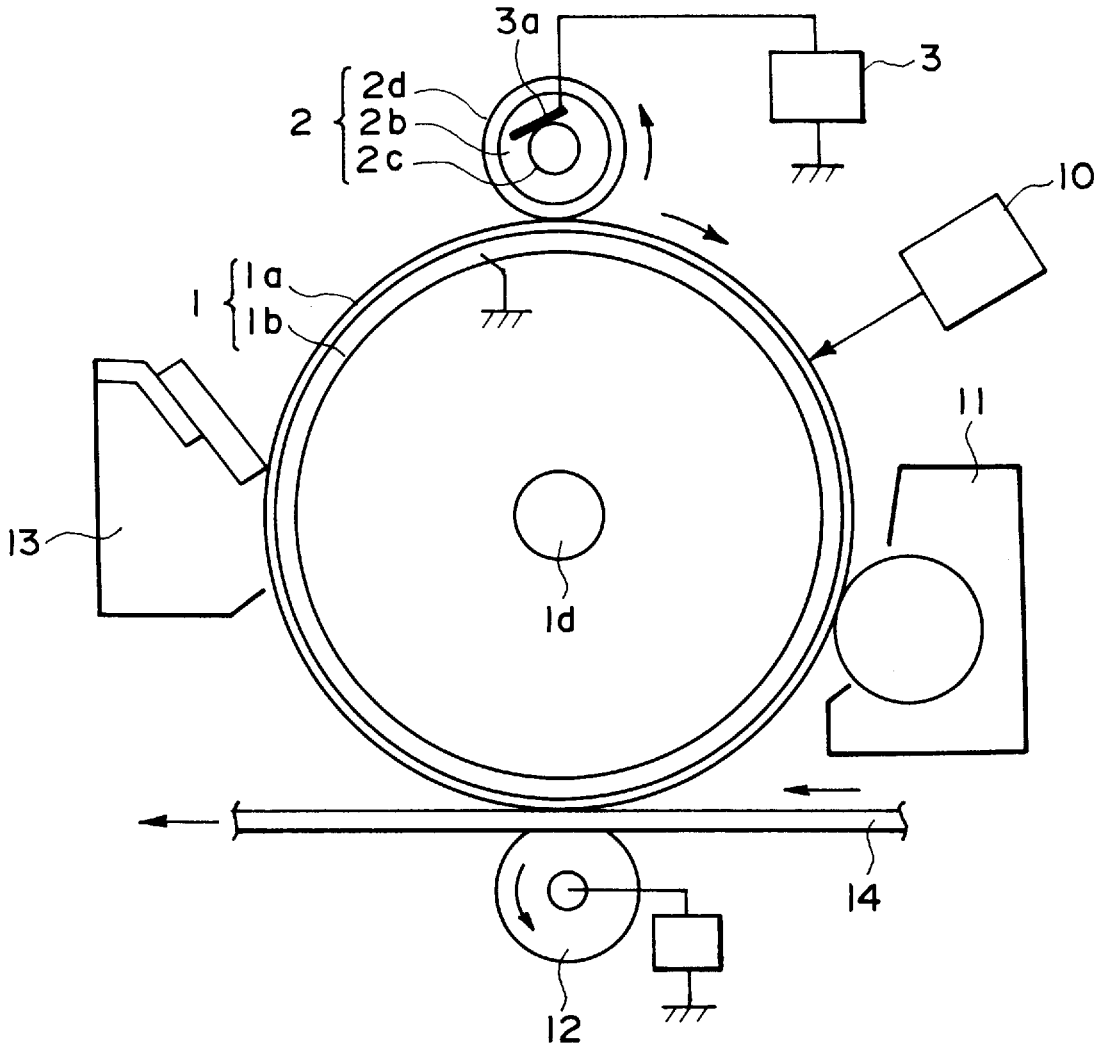
FIG. 2 is a schematic illustration of an electrophotographic apparatus including a charging member according to the invention.

FIG. 2 is a schematic cross-sectional view of an embodiment of an electrophotographic apparatus including the charging member according to the present invention.

Referring to FIG. 2, a drum-type electrophotographic photosensitive member 1 is used as a charge-receiving member or charge-carrying member and comprises an electroconductive support layer 1*b* of, e.g., aluminum, and a photoconductive layer 1*a* formed on the support layer 1*b*. The photosensitive member 1 is rotated about an axis 1*d* at a prescribed peripheral speed in the clockwise direction. The photosensitive member 1 is uniformly charged by means of a charging member (i.e., charging roller in this embodiment) 2 for performing primary charging (by contact or proximity charging) to have prescribed polarity and potential at the surface thereof. The charging roller 2 comprises a core metal (or a shaft) 2*c* as an electroconductive support, an elastic layer 2*b* and a surface layer 2*d* disposed in this order. The core metal 2*c* has both end sections at which the core metal is rotatably supported by a bearing member (not shown). The core metal 2*c* is disposed parallel to the axis 1*d*, and the charging roller 2 is caused to abut upon the photosensitive member 1 under a prescribed pressure exerted by a pressing member (not shown), thus rotating mating with the rotation of the photosensitive member 1.

The primary charging (by contact or proximity charging) is performed by applying a DC bias voltage or a superposition of a DC bias voltage and an AC bias voltage to the core metal 2*c* through a friction (or rubbing) electrode 3*a* by means of a power supply 3, thus providing the peripheral surface of the rotating photosensitive member 1 with a prescribed polarity and a prescribed potential.

The peripheral surface of the photosensitive member 1 uniformly charged by the charging member 2 as described above is then subjected to imagewise exposure (e.g., laser beam scanning exposure or slit exposure of an original image) by image exposure means 10, whereby an electrostatic latent image corresponding to original image data is formed on the peripheral surface of the photosensitive member 1. The thus formed latent image is developed or visualized by developing means 11 with a toner to form a toner image (or developed image) in sequence.

The toner image is successively transferred to the front side of a transfer-receiving material 14 such as paper, being timely conveyed from a supply part (not shown) to a transfer position between the photosensitive member 1 and transfer means 12 (i.e., transfer roller in this embodiment) in synchronism with the rotation of the photosensitive member 1, by the transfer means 12. The transfer means (roller) 12 is used for charging the back side of the transfer-receiving material 14 so as to have a polarity opposite to that of the toner, whereby the toner image formed on the photosensitive member 1 is transferred to the front side of the material 14.

Then, the transfer-receiving material 14 having thereon the toner image is detached from the surface of the photosensitive member 1 and is conveyed to fixing means (not shown), thus being subjected to image fixing to be outputted as an image-formed product. Alternatively, the transfer-receiving material 14 is carried to reconveying means for conveying the material 14 back to the transfer position in the case of image formation also on the back side of the material 14.

The surface of the photosensitive member 1 after the transfer operation is subjected to cleaning by cleaning means 13 for removing and recovering an attached matter, such as a residual toner, from the surface of the photosensitive member 1, thus obtaining a cleaned surface to prepare for the next cycle.

The charging member 2 may also be in the form of a blade, a block, a rod or a belt in addition to the above-mentioned roller-type charging member as shown in FIG. 2. In the present invention, a charging member in the form of a roller or a blade may preferably be used.

In the case of the charging member 2 of the roller-type, the charging member 2 may be rotated mating with movement of a charge-receiving member in the form of, e.g., a sheet or may be one being not rotatable. The charging member 2 may also be rotated for itself at a prescribed peripheral speed in the direction identical to or opposite to the moving direction of the charge-receiving member (e.g., sheet-type) or the rotating direction of the above-mentioned drum-type photosensitive member.

In the present invention, a plurality of elements or components of an electrophotographic apparatus such as the above-mentioned photosensitive member, charging member, developing means and cleaning means may be integrally assembled into a process cartridge, so that the cartridge may be detachably mountable to the apparatus main body (e.g., copying machine or laser beam printer). For example, a charging member may be integrally assembled together with a photosensitive member into a process cartridge, and such a cartridge may be attached to or detached from the apparatus body by the medium of a guiding means such as a rail of the apparatus body. In another embodiment, a cleaning means and/or developing means may be used together with a charging member and a photosensitive member to constitute a process cartridge.

In the case where the electrophotographic apparatus is used as a copying machine or printer, image exposure may be effected by using reflected light or transmitted light from an original or by reading data on the original, converting the data into a signal and then effecting a laser beam scanning, a drive of LED array or a drive of a liquid crystal shutter array in accordance with the signal.

In case where the electrophotographic apparatus including the charging member according to the present invention is used as a printer for facsimile, the above-mentioned image exposure means corresponds to that for printing received data. FIG. 3 shows such an embodiment by using a block diagram.

Figure 3:
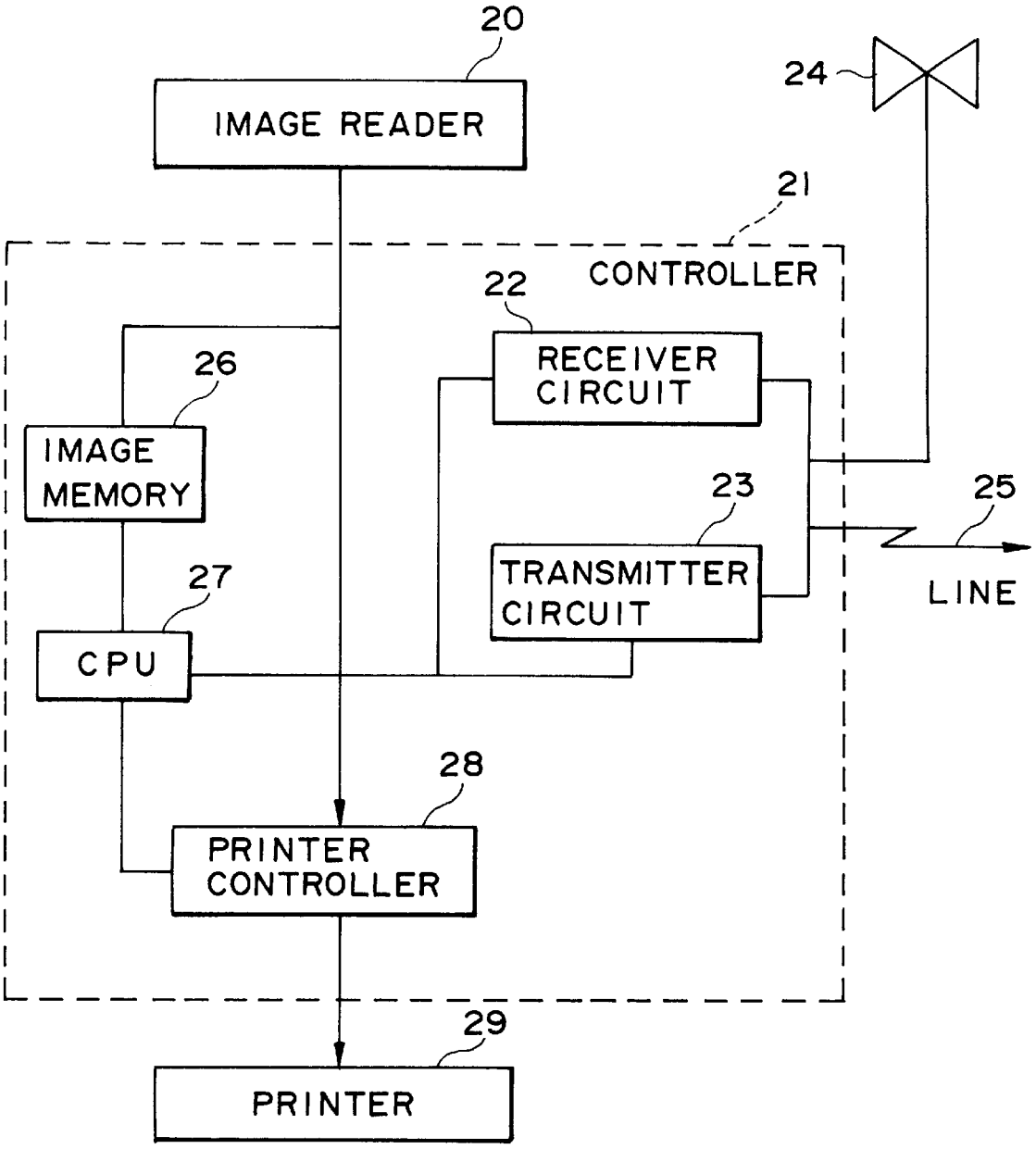
FIG. 3 is a block diagram of a facsimile apparatus including as a printer an electrophotographic apparatus including a charging member according to the invention.

Referring to FIG. 3, a controller 21 controls an image reader (or image reading unit) 20 and a printer 29. The entirety of the controller 21 is regulated by a CPU (central processing unit) 27. Read data from the image reader 20 is transmitted through a transmitter circuit 23 to another terminal such as a facsimile. On the other hand, data received from another terminal such as a facsimile is transmitted through a receiver circuit 22 to the printer 29. An image memory 26 stores prescribed image data. A printer controller 28 controls the printer 29. In FIG. 3, reference numeral 24 denotes a telephone set.

More specifically, an image received from a line (or circuit) 25 (i.e., image information received from a remote terminal connected by the line) is demodulated by means of the receiver circuit 22, decoded by the CPU 27, and sequentially stored in the image memory 26. When image data corresponding to at least one page is stored in the image memory 26, image recording is effected with respect to the corresponding page. The CPU 27 reads image data corresponding to one page from the image memory 26, and transmits the decoded data corresponding to one page to the printer controller 28. When the printer controller 28 receives the image data corresponding to one page from the CPU 27, the printer controller 28 controls the printer 29 so that image data recording corresponding to the page is effected. During the recording by the printer 29, the CPU 27 receives another image data corresponding to the next page.

Thus, receiving and recording of an image may be effected by means of the apparatus shown in FIG. 3 in the above-mentioned manner.

More specifically, an electrophotographic photosensitive member 1 as shown in FIG. 2 may be constituted in the following manner.

A photosensitive layer 1*a* may be formed on an electroconductive support 1*b*. The electroconductive support may be composed of a material which per se has an electroconductivity, e.g., a metal, such as aluminum, aluminum alloy, stainless steel or nickel, or may comprise a plastic material or glass coated, e.g., with a vapor-deposited film of aluminum, aluminum alloy or indium oxide-tin oxide.

It is also possible to dispose an undercoating layer having a barrier function and an adhesive function between the electroconductive support and the photosensitive layer. Such an undercoating layer may be formed of, e.g., casein, polyvinyl alcohol, nitrocellulose, ethylene-acrylic acid (or ethylene-acrylate) copolymer, polyamide (such as nylon 6, nylon 66, nylon 610, or copolymer nylon), polyurethane, gelatin, or aluminum oxide in a thickness of at most 5 $\mu$m, preferably 0.5–3 $\mu$m. The undercoating layer may desirably have a resistivity of at least $10^7$ ohm.cm in order to exhibit its function.

The photosensitive layer 1 may be formed as a coating layer of an organic or inorganic photoconductor, optionally together with a binder, or by vapor-deposition.

The photosensitive layer may preferably assume a function separation-type laminated photosensitive layer structure including a charge generation layer and a charge transport layer.

The charge generation layer may be formed as a coating layer of a charge generating substance, such as an azo pigment, phthalocyanine pigment or quinone pigment formed by vapor deposition or together with an appropriate binder resin, as desired, in a thickness of 0.01–5 $\mu$m, preferably 0.05–2 $\mu$m.

The charge transport layer may be formed as a coating layer of a charge transporting substance, such as a hydrazone compound, styryl compound, oxazole compound or triarylamine compound together with an appropriate film-forming binder resin in a thickness of 5–50 $\mu$m, preferably 10–30 $\mu$m.

It is also possible to dispose a protective layer on the photosensitive layer so as to prevent deterioration, e.g., by ultraviolet radiation.

The present invention will be more specifically descried with reference to Examples.

EXAMPLE 1

A charging roller 2 having a cross-section (taken perpendicularly to the roller axis) as shown in FIG. 1 was prepared.

A 6 mm dia.-core metal 2*c* of stainless steel in a length of 250 mm was coated in a length of 230 mm with a semiconductive sponge roller layer 2*b*.

The sponge roller layer 2*b* was composed from 100 wt. parts of an ethylene-propylene copolymer containing ethylidene norbornene as a diene component (ethylene/propylene=69/31; iodine value=29 as measured by Wijs method), 12 wt. parts of ketjen black, 5 wt. parts of zinc oxide, 1 wt. part of stearic acid, 55 wt. parts of paraffin oil, 2 wt. parts of sulfur, 2 wt. parts of mercaptobenzothiazole (vulcanizing accelerator),. 1 wt. part of zinc dibutyldithiocarbamate (vulcanizing accelerator), 1 wt. part of tetramethylthiuram disulfide (vulcanizing accelerator), 10 wt. parts of azodicarbonamide (ADCA) (foaming agent), 10 wt. parts of p,p'-oxybis(benzenesulfonylhyrazide) (OBSH) (foaming agent), and 5 wt. parts of urea resin (foaming assistant). The rubber mixture was shaped into a tube by extrusion and subjected to vulcanization inclusive of first vulcanization with water vapor for foaming at 160° C. for 30 min. and second vulcanization at 200° C. for 10 min. in an electric furnace.

Into the thus-formed foam tube, the core metal 2*c* to which an adhesive was applied was fit, followed by surface abrasion to form a sponge roller of 12 mm-diameter. The thus-formed sponge roller had a resistance of $5\times10^5$ ohm, an ASKER-C hardness of 38 degrees, and a uniform foam diameter of ca. 80 $\mu$m without causing abnormal foaming.

Figure 4:
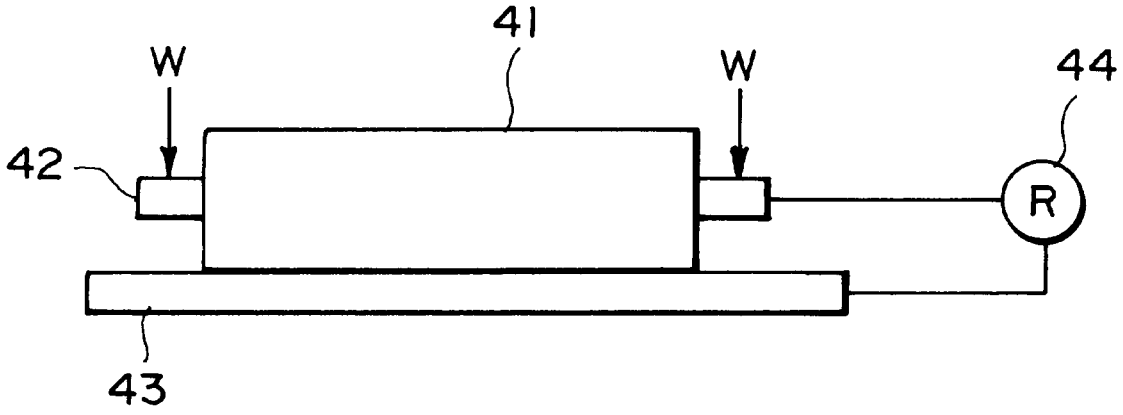
FIG. 4 is an illustration of a manner of measuring the resistance of a charging roller.

The resistance of the sponge roller was measured in a manner illustrated in FIG. 4. Specifically, wherein the resistance of a roller 41 was measured between a core metal 42 and an aluminum plate 43 by a resistance meter 44 under application of two loads W each of, e.g., 500 g (for providing a nip width of ca. 2 mm) on both lateral ends of the core metal 42 and an applied voltage of 100 volts.

Then, the sponge roller 2*b* was coated with a ca. 80 $\mu$m-thick surface layer 2*d* after coating with a silane coupling agent primer.

The coating of the surface layer 2*d* was performed by applying an aqueous coating dispersion comprising an aqueous polyurethane solution and an electroconductive tin oxide slurry including tin oxide particles dispersed in water (pH=5–6) due to electrical repulsion at the interface therebetween onto the surface of the sponge roller 2*c* by dipping, followed by hot drying at 120° C. for 30 min. in an electric furnace, thus preparing a charging roller 2. The coating dispersion had a solid content ratio of polyurethane/tin oxide particles=100/40 by weight.

The charging roller 2 showed a resistance (measured in the same manner as in the sponge roller 2*b*) of $1\times10^6$ ohm and a surface roughness Rz of ca. 7 μm, thus including a uniform surface layer 2*d* free from defects.

The thus-prepared charging roller 2 was incorporated in an image forming (electrophotographic) apparatus as shown in FIG. 2 and used for charging and image formation under application of a superposed voltage including a DC voltage of −700 volts and an AC voltage (sine wave) of 500 Hz and 2000 volts (Vpp), whereby the photosensitive member 1 could be uniformly charged at −700 volts under all environmental conditions inclusive of high temperature—high humidity and low temperature—low humidity.

Further, the charging roller was used for 50000 sheets of successive image formation. Even after the successive image formation, the charging roller caused no surface abrasion of the photosensitive member 1, and showed an identical charging characteristic as the initial stage.

Then, the charging roller 2 was incorporated in a process cartridge together with the photosensitive member 1 (30 mm in diameter) under application of two loads each of 500 g on both lateral ends of the charging roller 2 so as to be pressed against the photosensitive member. The process cartridge in such a state was left standing for 30 days in an environmental condition of 40° C. and 95 % RH.

After the standing, when the charging roller 2 was subjected to measurement of a permanent set (a degree of residual or permanent deformation) immediately after removing the pressure exerted between the charging roller and the photosensitive member, the charging roller showed a permanent set of ca. 80 μm. The permanent set of the charging roller was determined as a difference between the thickness before the pressure (load) application and the thickness immediately after the removal of the pressure (load). Thereafter, the charging roller 2 was again subjected to image formation, whereby a good image free from an image defect was obtained.

EXAMPLE 2

A charging roller was prepared and evaluated in the same manner as in Example 1 except that the ethylene-propylene copolymer was changed to an ethylene-propylene copolymer containing ethylidene norbornene and vinyl norbornene as a diene component (ethylene/propylene=68/32; iodine value=32).

The thus formed sponge roller had a resistance of $7\times10^5$ ohm, an ASKER-C hardness of 40 degrees, and a foam diameter of ca. 70 μm without causing any abnormal foaming.

The resultant charging roller had a resistance of $1\times10^6$ ohm and a surface roughness Rz of ca. 5 μm, thus having a uniform surface layer free from defects.

The charging roller also showed similar performances as in Example 1 and had a permanent set of ca. 50 μm.

EXAMPLE 3

A charging roller was prepared and evaluated in the same manner as in Example 1 except that the ethylene-propylene copolymer was changed to an ethylene-propylene copolymer containing ethylidene norbornene and vinyl norbornene as a diene component (ethylene/propylene=67/33; iodine value=23).

The thus formed sponge roller had a resistance of $7\times10^5$ ohm, an ASKER-C hardness of 38 degrees, and a foam diameter of ca. 80 μm without causing any abnormal foaming.

The resultant charging roller had a resistance of $1\times10^6$ ohm and a surface roughness Rz of ca. 6 μm, thus having a uniform surface layer free from defects.

The charging roller also showed similar performances as in Example 1 and had a permanent set of ca. 60 μm.

COMPARATIVE EXAMPLE 1

A charging roller was prepared and evaluated in the same manner as in Example 1 except that the ethylene-propylene copolymer was changed to an ethylene-propylene copolymer containing ethylidene norbornene and vinyl norbornene as a diene component (ethylene/propylene=74/26; iodine value=19).

The thus formed sponge roller had a resistance of $1\times10^6$ ohm, an ASKER-C hardness of 35 degrees, and a foam diameter of ca. 110 μm without causing any abnormal foaming.

The resultant charging roller had a resistance of $1\times10^6$ ohm and a surface roughness Rz of ca. 10 μm, thus having a uniform surface layer free from defects.

The charging roller also showed similar charging performances as in Example 1 but had a permanent set of ca. 100 μm.

When the charging roller after the measurement of the permanent set was subjected to image evaluation with respect to half-tone image, an overcurrent passed through the permanent set (deformation) portion to cause image failure evaluated as an image density irregularity (unevenness) on the image-formed sheets at respective positions corresponding to the permanent set portion of the charging roller.

EXAMPLE 4

A charging roller was prepared and evaluated in the same manner as in Example 1 except that the ethylene-propylene copolymer was changed to an ethylene-propylene copolymer containing ethylidene norbornene and vinyl norbornene as a diene component (ethylene/propylene=68/32; iodine value=32) and that the addition amount of ADCA and OBSH were changed to 12 wt. parts and 6 wt. parts, respectively.

The thus formed sponge roller had a resistance of $5\times10^5$ ohm, an ASKER-C hardness of 42 degrees, and a foam diameter of ca. 90 μm without causing any abnormal foaming.

The resultant charging roller had a resistance of $1\times10^6$ ohm and a surface roughness Rz of ca. 7 μm, thus having a uniform surface layer free from defects.

The charging roller also showed similar performances as in Example 1 and had a permanent set of ca. 50 μm.

EXAMPLE 5

A charging roller was prepared and evaluated in the same manner as in Example 1 except that the ethylene-propylene copolymer was changed to an ethylene-propylene copolymer containing ethylidene norbornene and vinyl norbornene as a diene component (ethylene/propylene=68/32; iodine value=30) and that the addition amounts of ADCA and OBSH were charged to 12 wt. parts and 6 wt. parts, respectively.

The thus formed sponge roller had a resistance of $7\times10^5$ ohm, an ASKER-C hardness of 42 degrees, and a foam diameter of ca. 90 μm.

The resultant charging roller had a resistance of $1\times10^6$ ohm and a surface roughness Rz of ca. 7 μm.

The charging roller also showed similar performances as in Example 1 and had a permanent set of ca. 65 μm.

When the charging roller was subjected to successive image formation of 30000 sheets in a low temperature-low humidity environment, the charging roller caused no surface abrasion of the photosensitive member and showed an identical charging characteristic as the initial stage.

EXAMPLE 6

A charging roller was prepared and evaluated in the same manner as in Example 1 except that the addition amounts ADCA and OBSH were changed to 15 wt. parts and 3 wt. parts, respectively.

The thus formed sponge roller had a resistance of $5\times10^5$ ohm, an ASKER-C hardness of 44 degrees, and a foam diameter of ca. 150 μm.

The resultant charging roller had a resistance of $2\times10^6$ ohm and a surface roughness Rz of ca. 10 μm, thus having a uniform surface layer free from defects.

The charging roller also showed similar performances as in Example 1 and had a permanent set of ca. 55 μm.

COMPARATIVE EXAMPLE 2

A charging roller was prepared and evaluated in the same manner as in Example 1 except that the ethylene-propylene copolymer was changed to an ethylene-propylene copolymer containing ethylidene norbornene and vinyl norbornene as a diene component (ethylene/propylene=63/37; iodine value=12).

The thus formed sponge roller had a resistance of $2\times10^6$ ohm, an ASKER-C hardness of 34 degrees, and a foam diameter of ca. 120 μm without causing any abnormal foaming.

The resultant charging roller had a resistance of $1\times10^6$ ohm and a surface roughness Rz of ca. 12 μm, thus having a uniform surface layer free from defects.

The charging roller also showed similar charging performances as in Example 1 but had a permanent set of ca. 140 μm.

When the charging roller after the measurement of the permanent set was subjected to image evaluation with respect to half-tone image, an overcurrent passed through the permanent set (deformation) portion to cause image failure on the image-formed sheets at respective positions corresponding to the permanent set portion of the charging roller.

Further, when the charging roller was used for 30000 sheets of successive image formation, abrasion of the photosensitive member surface due to a local discharge of the charging roller surface was observed and charging failure due to leakage occurred.

COMPARATIVE EXAMPLE 3

A charging roller was prepared and evaluated in the same manner as in Example 1 except that the ethylene-propylene copolymer was changed to an ethylene-propylene copolymer containing ethylidene norbornene and vinyl norbornene as a diene component (ethylene/propylene=72/28; iodine value=15) and that the addition amount of ADCA and OBSH were changed to 3 wt. parts and 18 wt. parts, respectively.

The thus formed sponge roller had a resistance of $3\times10^6$ ohm, an ASKER-C hardness of 32 degrees, and a foam diameter of ca. 120 μm without causing any abnormal foaming.

The resultant charging roller had a resistance of $1\times10^6$ ohm and a surface roughness Rz of ca. 16 μm, thus having a uniform surface layer free from defects.

The charging roller also showed similar performances as in Example 1 but had a permanent set of ca. 150 μm.

When the charging roller after the measurement of the permanent set was subjected to image evaluation with respect to half-tone image, an overcurrent passed through the permanent set (deformation) portion to cause image failure on the image-formed sheets at respective positions corresponding to the permanent set portion of the charging roller.

Further, when the charging roller was used for 30000 sheets of successive image formation, abrasion of the photosensitive member surface due to a local discharge of the charging roller surface was observed and charging failure due to leakage occurred.

What is claimed is:

1. A charging member, which is supplied with a voltage to charge a charge-receiving member, having an elastic layer comprising an ethylene-propylene copolymer containing a diene component; wherein said ethylene-propylene copolymer has an iodine value of 23–32.

2. A member according to claim 1, wherein said diene component comprises ethylidene norbornene.

3. A member according to claim 1, wherein said diene component comprises ethylidene norbornene and vinyl norbornene.

4. A member according to claim 1, which comprises a surface layer disposed on said elastic layer.

5. A member according to claim 1, which has a surface roughness of at most 10 μm.

6. A member according to claim 1, wherein said elastic layer comprises a layer of electroconductive foam.

7. A process cartridge, detachably mountable to an electrophotographic apparatus main body, comprising a charging member and a photosensitive member; wherein said charging member has an elastic layer comprising an ethylene-propylene copolymer containing a diene component, said ethylene-propylene copolymer having an iodine value of 23–32.

8. A cartridge according to claim 7, wherein said elastic layer comprises a layer of electroconductive foam.

9. An electrophotographic apparatus, comprising a charging member and a photosensitive member; wherein said charging member has an elastic layer comprising an ethylene-propylene copolymer containing a diene component, said ethylene-propylene copolymer having an iodine value of 23–32.

10. An apparatus according to claim 9, wherein said elastic layer comprises an ethylene-propylene copolymer.

* * * * *